United States Patent [19]

Bickes, Jr. et al.

[11] Patent Number: 4,621,577

[45] Date of Patent: Nov. 11, 1986

[54] MINIATURE PLASMA ACCELERATING DETONATOR AND METHOD OF DETONATING INSENSITIVE MATERIALS

[75] Inventors: Robert W. Bickes, Jr.; Michael R. Kopczewski; Alfred C. Schwarz, all of Albuquerque, N. Mex.

[73] Assignee: The United States of America as represented by the Department of Energy, Washington, D.C.

[21] Appl. No.: 688,672

[22] Filed: Jan. 4, 1985

[51] Int. Cl.[4] ..... F42B 3/14

[52] U.S. Cl. ..... 102/200; 89/8

[58] Field of Search ..... 89/8; 124/3; 102/200

[56] References Cited

U.S. PATENT DOCUMENTS

| | | | |
|---|---|---|---|
| 3,490,372 | 1/1970 | Lavine | 89/8 X |
| 3,916,761 | 11/1975 | Fletcher et al. | 89/8 |
| 4,157,054 | 6/1979 | Cobb | 89/8 |
| 4,334,474 | 6/1982 | Coltharp | 102/206 |
| 4,485,720 | 12/1984 | Kemeny | 102/520 X |
| 4,555,972 | 12/1985 | Heyne | 89/8 |

OTHER PUBLICATIONS

Railgun Accelerators for Gram-Sized Projectiles, R. S. Hawke, Lawrence Livermore Nt. Lab., I.E.E.E. Transactions in Nuclear Sciences, NS-28, No. 2, Apr. 1981, discussed in application.

Megagauss Physics & Tech., P. J. Turchi, 1979, Teaches Plasma Armature Projectiles, (a) Magnetic Propulsion for a Hypervelocity Launcher, pp. 287-295, J. P. Barber et al., (b) Magnetic Propulsion Railguns: Their Design and Capabilities, pp. 297-311, R. S. Hawke et al.

J. Appl. Phys., Apr. 1980, Acceleration of Projectiles to Hypervelocities Using a Series of Imploded Annular Plasma Discharges, pp. 1975-1983, D. A. Tidman et al., Teaches Series of Imploded Annular Plasma Pinches to Propell Projectiles.

UCRL-52788, May 1, 1979, Devices for Launching 0.1-g Projectiles to 150 km/s or More to Initiate Fusion: Part 1, Magnetic-Gradient and Electrostatic Accelerators, pp. 1-33, J. N. Brittingham Teaches Accelerating Particles to Hypervelocities.

*Primary Examiner*—Peter A. Nelson

*Attorney, Agent, or Firm*—James H. Chafin; Albert Sopp; Judson R. Hightower

[57] ABSTRACT

The invention is a detonator for use with high explosives. The detonator comprises a pair of parallel rail electrodes connected to a power supply. By shorting the electrodes at one end, a plasma is generated and accelerated toward the other end to impact against explosives. A projectile can be arranged between the rails to be accelerated by the plasma. An alternative arrangement is to a coaxial electrode construction. The invention also relates to a method of detonating explosives.

16 Claims, 3 Drawing Figures

Figure 1:
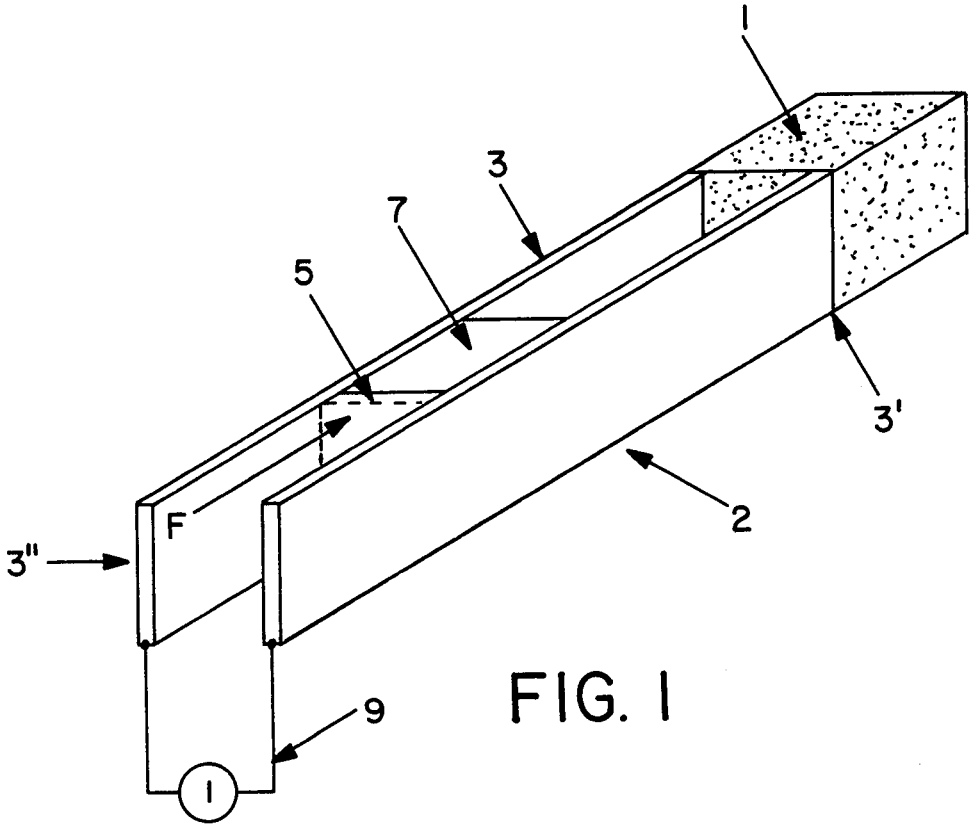

MINIATURE PLASMA ACCELERATING DETONATOR AND METHOD OF DETONATING INSENSITIVE MATERIALS

The U.S. Government has rights in this invention pursuant to Contract No. DE-AC04-76DP-00789 between the U.S. Department of Energy and AT&T Technologies, Inc.

BACKGROUND OF THE INVENTION

This invention relates to a device and method for generating and accelerating a plasma to detonate an explosive such as an insensitive explosive or energetic material. The improved detonator is employed to replace conventional mechanical "flying plate" devices used in detonating such materials.

A review of the prior art literature reveals that large railgun accelerators have been employed for propelling one gram projectiles to velocities of 20 kg per second, for launching payloads into orbit, and even to obtaining projectile velocities of 100 kg per second or more. Such a discussion is, for example, provided in the paper prepared by R. S. Hawk entitled "Railgun Accelerators for Launching 0.1 gram Payloads at Velocities Greater Than 100 km per Second," dated June 15, 1979 and presented at the DOE sponsored Impact Fusion Workshop, July 10–13, 1979 at the Los Alamos Scientific Laboratory, and which disclosure is incorporated by reference herein. In this paper, a railgun accelerator is discussed as being a linear DC motor consisting of a pair of rigid, field-producing conductors and a moveable conducting armature. The armature is accelerated as a result of the Lorentz force F produced by the magnetic field B of the rail currents interacting with the current I in the armature throughout its width w wherein, $$F = \int_0^w \frac{I\,dw \times B}{m} = \frac{L_1 I^2}{2m},$$

and $L_1$ is the specific railgun inductance in H/m, and m is the mass of the projectile. Typically, the armature is a thin plasma arc that impinges on the backside of a dielectric projectile and accelerates it. The arc is presumed to be confined behind the projectile by the conducting rails on the two sides and dielectric rail spacers inbetween.

To supply the current to the prior art railguns, a primary energy storage device (PESD), such as a capacitor bank or a homopolar generator (HPG), and a pulse-forming or storage inductor $L_0$ is employed. Accordingly, such a device has been proposed to launch impactors of 1 to 10 grams of mass or more at velocities of 20 km per second or more at low cost. (See also, for example, "Railgun Accelerators for Gram-sized Projectile" IEEE Transactions in Nuclear Science, NS-28, No. 2, April 1981 by R. S. Hawk, which disclosure is also incorporated by reference.)

In a related aspect, U.S. Pat. No, 3,916,761 to Fletcher et al., discloses a device for accelerating a projectile to extremely high velocities which includes a light gas accelerator to impart an initial high velocity to the projectile on a plasma accelerator and compressor receiving the moving projectile, and then accelerating it to higher velocities. As in the case with the Hawk's device, projectile velocities on the order of 20 km per second can be obtained for use in the accelerator in the field of meteoroid simulation.

SUMMARY OF THE INVENTION

It is thus an object of the present invention to miniaturize such accelerators and adapt them for initiating detonation of insensitive explosives or energetic materials.

It is another object of the invention to provide such a miniaturized accelerator having the capability of obtaining velocities many times greater than that achievable by conventional bursting-foil propelled, flying-plate detonators.

Still another object of the present invention is to provide such a detonator which employs the generated plasma directly as the "slapper" mass, instead of propelling a solid projectile to initiate detonation of the explosive.

Yet still another object of the invention is to provide a method of detonating an insensitive explosive or energetic material by the use of a miniaturized railgun type accelerator/detonator.

Upon further study of the specification and appended claims, further objects and advantages of this invention will become apparent to those skilled in the art.

In accordance with the invention, an improvement is provided in a detonator assembly for initiating detonation of insensitive explosives or energetic materials. The improved detonator comprises railgun accelerating means of a size sufficient to be used as a detonator for insensitive explosive or energetic materials and capable of accelerating a plasma to detonation initiating velocities. In addition, power supply means is provided for supplying the power necessary to said railgun accelerating means to generate and accelerate said plasma to achieve detonation.

In a more specific aspect, the railgun accelerating means comprises a miniature pair of parallel rail electrodes having means for shorting the electrodes at the power supply means end to generate a plasma to be accelerated by said parallel rail electrodes. The power supply means comprises a capacitor discharge unit, i.e., CDU, for providing a current pulse to the railgun accelerating means to thereby generate the plasma and accelerate the plasma along the rails by means of an electromagnetic field generated by the rails.

In an alternative construction, the railgun accelerating means comprises a coaxial railgun with an outer cylindrical electrode and a coaxially arranged inner rod-like electrode for generating the plasma discharge and then intensifying it into a narrow conducting region accelerated down the railgun accelerating means toward a configuration of maximum inductance at one end of the coaxial railgun.

For a more detailed discussion of the plasma generation techniques and acceleration to hypervelocity, see the article "Acceleration of Projectiles to Hypervelocities Using a Series of Imploded Annualar Plasma Discharges" by D. A. Tidman and S. A. Goldstein, published in the Journal of Applied Physics 51(4) April 1980, whose disclosure is specifically incorporated by reference herein. Typically, in such an arrangement switching of a capacitor across the rails produces an arc as close to the capacitor circuit as possible to minimize circuit inductance. Arc plasma formation is readily enhanced by means of a thin metal foil shorting the rails at the capacitor end and the plasma discharge then intensifies into a narrow conducting region which is accelerated down the railgun picking up more gas and accumulating and creating more plasma toward a configuration of maximum mass and velocity at the other end.

In another aspect, the invention is directed to a method of detonating an insensitive explosive or energetic material. The method comprises the steps of coupling the insensitive explosive or energetic material to a miniaturized railgun accelerator as discussed, generating a plasma at one end of the accelerator and accelerating a mass to impact on said insensitive explosive or energetic material, thereby initiating detonation thereof. It is understood that the expressions "insensitive explosive" "energetic material" are being used interchangeably to refer to what is known in the art as "high" or "secondary" explosives characterized by explosives presently commercially available such as, but not limited to, HMX, HNAB, TATB, PETN and RDX.

In a preferred aspect in both the device and the method, the generated plasma is itself employed as the mass which is impacted on the insensitive explosive without the requirement of employing a separate projectile to be accelerated by the plasma.

BRIEF DISCUSSION OF THE DRAWINGS

Figure 2:
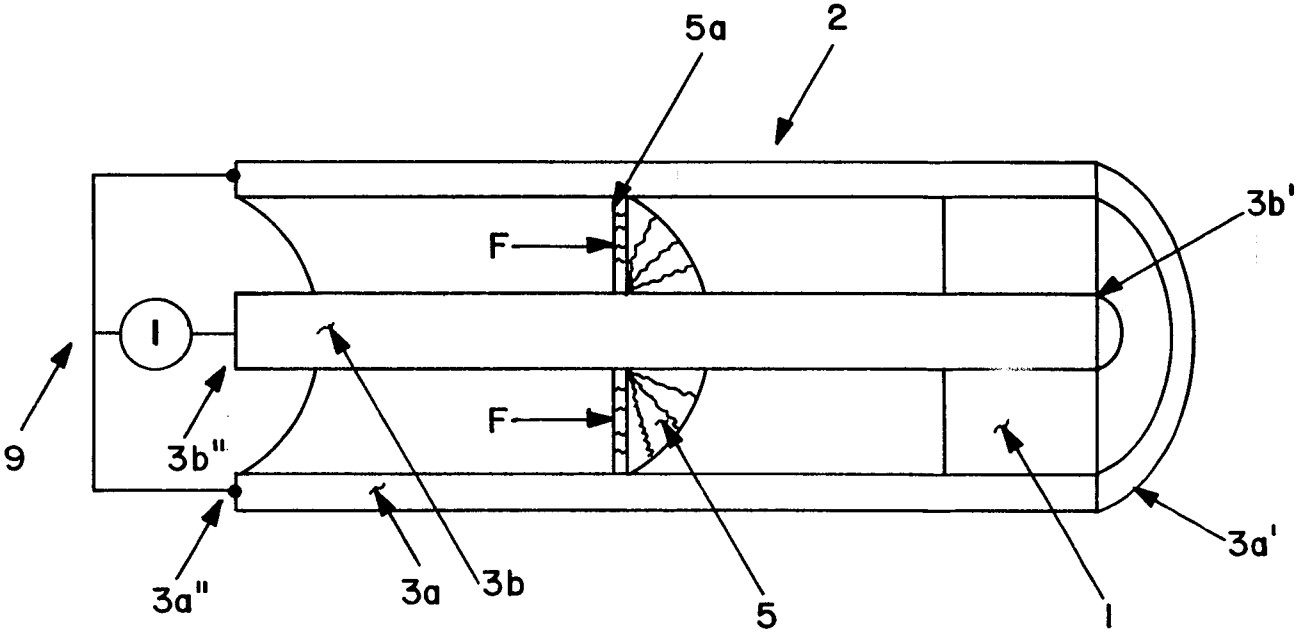
Figure 3:
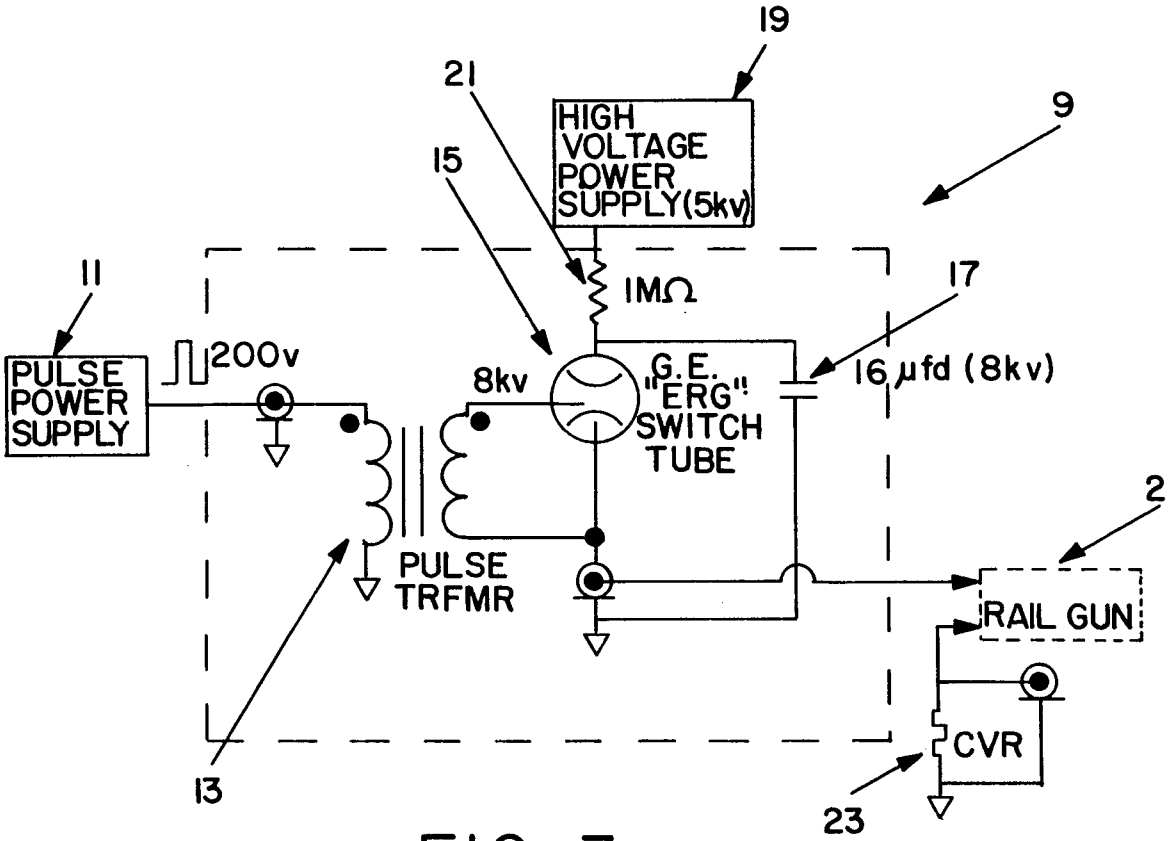

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 1 is a schematic diagram of a parallel plate railgun detonator typically employed with a solid projectile to be accelerated by a generated plasma to impinge directly on an explosive to thereby produce initiation of detonation;

FIG. 2 is a cross-sectional schematic diagram of a modification of the railgun detonator of the invention showing a coaxial arrangement with the explosive pressed inside the coaxial electrode for electromagnetic enhancement of the detonation output, and which does not require the use of a solid projectile and instead initiates detonation directly with a generated plasma; and FIG. 3 is a schematic diagram of a typical circuit of a capacitive discharge unit power supply employed in connection with the railgun detonator of the invention.

DETAILED DISCUSSION OF THE INVENTION

The invention illustrated in FIGS. 1, 2 and 3 relates to an improved detonator for use in place of a conventional "slapper" type detonator typically used to detonate insensitive explosives or energetic material more typically known as secondary or high explosives, and as previously discussed, including such as HMX, HNAB, TATB, PETN, and RDX. These explosives are generally known as explosives which are insensitive to low energy impact, require high energy impact, and are typically detonated by conventional slapper detonators of the type wherein a filament explodes over a slapper projectile and the high pressure gas generated by the exploding filament accelerates and impacts the slapper projectile against the explosive to be detonated. The amount of explosive to be detonated or ignited is typically 100 mg or less with the velocities required to achieve detonation by the accelerating slapper being typically about 3 mm/$\mu$s.

In accordance with the invention disclosed in FIG. 1, the detonator 2 is a miniaturized parallel plate railgun having two electrode rails 3 connected at one end 3'' to a power supply 9, typically a capacitor discharge unit which is of conventional construction well known to those of ordinary skill in the art. The detonator 2 itself has an overall size of typically about a 2 inch cube with the power supply required being only one capable of generating about 1 kamp. Attached at the other end 3' of the rails 3 is an explosive 1, i.e., an insentive explosive or energetic material as above described.

As with conventional prior art slapper type detonators, a slapper projectile 7 is arranged between the rails which support powering of the detonator 2 by means of the power supply 9. The projectile 7 is accelerated and impacted against the explosive 1 to cause detonation thereof. Acceleration is caused by a plasma 5 generated as a result of the supply of power to the rails 3 behind the projectile 7 which then accelerates as a plasma armature between the rails 3 forcing the projectile 7 to impact against the explosive 1.

The projectile 7 itself will typically be made of conventional material and be of a relatively small size and mass since the velocities achieved, typically 3 mm/$\mu$s are sufficient with such a small mass to ignite the explosive. Alternatively, it is possible to eliminate the use of the projectile 7 and use the thus-generated plasma itself as accelerated and impacted against the explosive 1 to produce initiation of ignition. This would be sufficient to initiate ignition since direct impingement of the plasma on the explosive to be initiated is advantageous because of its high temperature, and in many cases, its high shock impedance.

In the case when only the plasma is to be used, arc/-plasma formation can be readily enhanced by means of, for example, a thin metal foil, a highly doped semiconductor layer or a conductive metal oxide layer shorting the rails at the capacitor end. Such thin layers will then vaporize to form the plasma which then intensifies into a narrow conducting region which is accelerated down the railgun toward a configuration of maximum inductance at the target end. As an alternative to the parallel rail arrangement in FIG. 1, a coaxial railgun configuration such as that disclosed in FIG. 2 could be employed. With such an arrangement, enhancement of the explosive output due to the intense generated electromagnetic field is possible. This is because the explosive has the center rod **3*b*** embedded therein resulting in an intense electromagnectic field generated within the explosive.

As shown in FIG. 2, an alternative construction for the detonator 2 can be a coaxial configuration having an outer cylindrical electrode rail **3*a*, an inner rod-like electrode rail 3*b*. At the end 3*b'* of the inner rod-like electrode rail 3*b* is located the explosive 1 which has the end 3*b'* of the inner rod-like electrode 3*b* embedded therein, and with said explosive 1 also being attached to the outer end 3*a'* of the outer electrode rail 3*a*. At the opposite ends 3*b''* and 3*a''* is connected the power supply 9 which is used to generate the plasma which is accelerated down along the rails to impact against the explosive 1**.

The plasma is generated by means of a thin conductive layer **5*a* located at the ends 3*b'* and 3*a''* coaxially arranged around the inner rod-like electrode 3*b*. Upon initiation of the power supply the coaxial layer 5*a* vaporizes and generates a plasma. The thus-generated plasma of the vaporized material 5*a* is accelerated down toward the explosive 1. With this design, as discussed, enhancement of the explosive output due to the intense electromagnetic fields generated within the explosive as a result of the intimate relationship with the electrode rails 3***a* and 3*b* occurs and a projectile is not necessary.

As a power supply for the detonator, there is typically employed a conventional capacitor discharge unit, CDU, shown as element 9 and illustrated by (i) in FIGS. 1 and 2. However, the power supply source is not limited only to CDU sources and other equivalent sources can be employed as will become evident to those of ordinary skill in this art. The power supply 9 or CDU is generally identified in broken lines in FIG. 3 with other associated devices being shown outside the broken line box illustrated.

A typical device for use in this invention will include a pulse power supply 11 capable of providing, upon initiation by a push-button switch, a 200 volt pulse to the CDU source 9. In the CDU source 9, the 200 volt trigger pulse is applied to a pulse transformer 13 which produces an 8 kV output which fires a conventional switch 15, conventionally known as a GE "ERG" switch tube which is presently commercially available. Other conventional equivalent switch tubes as known to those of ordinary skill in the art can be employed.

Closing of the switch tube 15 discharges a capacitor 17, typically a 16 μfd capacitor which has been previously charged by connection to an outside connected high voltage power supply 19, typically a 5 kV commercial power supply which provides the voltage required for the desired current output to the railgun. Interposed is a resistor typically a 1 MΩ resistor 21 which isolates the power supply from the CDU 9. Therefrom, the output current is monitored across a current viewing resistor 23, typically about a 0.02015 ohm current viewing resistor. The overall arrangement consists of assembling the railgun of FIGS. 1 or 2 and connecting the rails at the end opposite the explosive to the CDU 9. The firing is then initiated when the operator presses the trigger pulse power supply 11 start switch.

With respect to the materials used in constructing the detonator railgun, it is noted that with conventional railguns such as those used for launching 0.1 gm projectiles to 100 km/s or more to initiate fusion or to place a projectile in orbit, there are problems with respect to heat generated as well as resistance to the various forces applied to both the rails as well as to the projectile. This is especially evident in such railguns which are typically of the size of an I-beam and which are designed for repetitive use. On the other hand, since the present invention is directed to a railgun detonator which is miniaturized as previously noted, and which is designed for one use with the railgun detonator being subsequently destroyed upon detonation of the explosive, it is much simpler to construct and the materials employed being substantially less expensive.

For instance, the rails themselves can be made of copper, stainless steel, tungsten or molybdenum, or any other conventional well-known high temperature high strain material having good conductivity. Moreover, since the size of the railgun is small, the power supply can be very small as opposed to the required massive power supplies used with conventional railguns which require typically a room full of transformers.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a detonator assembly for initating insensitive explosives or energetic materials, the improvement wherein said detonator assembly comprises: railgun accelerating means of a size sufficient to be used as a detonator for insensitive explosives or energetic materials in an amount of about 100 mg of explosives or less and capable of accelerating a plasma to detonation intiating velocities; and power supply means for supplying the power necessary to said railgun accelerating means to generate and accelerate said plasma.

2. A detonator as in claim 1 wherein said railgun accelerating means comprises a miniature pair of parallel rail electrodes having means for shorting the electrodes at the power supply means end to generate a plasma to be accelerated by said parallel rail electrodes.

3. A detonator as in claim 2 wherein said power supply means comprises a capacitor discharge unit for providing a current pulse to the railgun accelerating means to thereby generate said plasma and accelerate said plasma along said rails by means of an electromagnetic field generated by said rails.

4. A detonator as in claim 3 further comprising a solid projectile arranged within said rails, separate from the plasma to be generated, for being accelerated by a plasma to be generated by said rails, to impact against and initiate explosion of an insensitive explosive or energetic material.

5. A detonator as in claim 1 wherein said railgun accelerating means comprises a coaxial railgun with an outer cylindrical electrode and a coaxially arranged inner rod-like electrode for generating a plasma discharge and then intensifying it into a narrow conducting region accelerated down the railgun accelerating means toward a configuration of maximum inductance at one end of the coaxial railgun.

6. A detonator as in claim 5 wherein said power supply means comprises a capacitor discharge unit for providing a pulse current to the railgun accelerating means to thereby generate said plasma and accelerate said plasma along said electrodes by means of an electromagnetic field generated from said electrodes.

7. A detonator as in claim 3 wherein said rails are constructed for generating a sufficient plasma for being acclerated and employed as an impact mass for initiating detonation of an insensitive explosive or energetic material arranged at one end of the rails.

8. A detonator as in claim 7 wherein said electrodes are constructed for generating a sufficient plasma for being accelerated and employed as an impact mass for initiating detonation of an insensitive explosive or energetic material arranged at one end of the electrodes.

9. A detonator as in claim 7 further comprising an insensitive explosive coupled to said rails.

10. A detonator as in claim 8 further comprising an insensitive explosive coupled to said electrodes.

11. A method of detonating an insensitive explosive or energetic material comprising the steps of coupling the insensitive explosive or energetic material to a railgun accelerator, generating a plasma at one end of the accelerator and accelerating a mass to impact on said insensitive explosive or energetic material thereby causing detonation thereof.

12. A method as in claim 11 wherein said mass is a solid projectile accelerated by the generated plasma.

13. A method as in claim 11 wherein said mass accelerated is said plasma.

14. A method as in claim 12 wherein said projectile is accelerated to velocities greater than those possible with bursting-foil-propelled flying plate detonators.

15. A method as in claim 13 wherein said plasma is accelerated to velocities greater than those possible with bursting-foil-propelled flying plate detonators.

16. A method as in claim 11 wherein said plasma is generated with a parallel plate railgun.

* * * * *

UNITED STATES PATENT AND TRADEMARK OFFICE

CERTIFICATE OF CORRECTION

PATENT NO. : 4,621,577

DATED : November 11, 1986

INVENTOR(S) : Robert W. Bickes, Jr.; Michael R. Kopczewski; Alfred C. Schwarz

It is certified that error appears in the above-identified patent and that said Letters Patent is hereby corrected as shown below:

Column 1, lines 20 and 22, change "kg per second" to —km per second—.

Signed and Sealed this

Sixth Day of October, 1987

*Attest:*

DONALD J. QUIGG

*Attesting Officer*

*Commissioner of Patents and Trademarks*